United States Patent [19]

Engel et al.

[11] Patent Number: 4,864,838

[45] Date of Patent: Sep. 12, 1989

[54] DRIVE APPARATUS FOR THE VERTICAL ROLLS OF A UNIVERSAL ROLLING MILL STAND

[75] Inventors: Georg Engel, Kaarst; Hans-Heinrich Hartmann, Meerbusch; Peter Koethe, Ratingen; Alexandr Svagr, Hilden; Bernd Onderka, Korschenbroich, all of Fed. Rep. of Germany

[73] Assignee: SMS Schloemann-Siemag Aktiengesellschaft, Dusseldorf, Fed. Rep. of Germany

[21] Appl. No.: 85,995

[22] Filed: Aug. 14, 1987

[30] Foreign Application Priority Data

Aug. 14, 1986 [DE] Fed. Rep. of Germany ..... 3627630

[51] Int. Cl.[4] ..... B21B 13/10; B21B 35/06; B21B 35/12

[52] U.S. Cl. ..... 72/225; 72/236; 72/249; 310/157

[58] Field of Search ..... 72/249, 225, 224, 235, 72/236; 310/12, 13, 166, 71, 157

[56] References Cited

U.S. PATENT DOCUMENTS

| | | | |
|---|---|---|---|
| 344,383 | 6/1886 | Kennedy et al. | 72/225 |
| 587,958 | 8/1897 | Grey | 72/225 |
| 3,611,777 | 10/1971 | Bretschneider | 72/249 |
| 3,765,212 | 10/1973 | Moslener | 72/249 |
| 3,828,600 | 8/1974 | Borisenko et al. | 72/249 |
| 3,898,830 | 8/1975 | Borisenko et al. | 72/224 X |
| 3,922,900 | 12/1975 | Kishikawa et al. | 72/225 |

FOREIGN PATENT DOCUMENTS

| | | | |
|---|---|---|---|
| 1118724 | 12/1961 | Fed. Rep. of Germany . | |
| 0105959 | 9/1976 | Japan | 72/225 |

*Primary Examiner*—Robert L. Spruill
*Assistant Examiner*—Steven B. Katz
*Attorney, Agent, or Firm*—Herbert Dubno

[57] ABSTRACT

To avoid impacts on the first pass of the rolled product through a universal rolling mill the vertical rolls of the rolling mill can be provided with their own integral drive according to our invention. In an electrical drive for a vertical roll the vertical roll is the rotor of an electric motor while the stator is a circular collar on a nonrotatable supporting axle for the vertical roll. In a hydraulic drive for a vertical roll a hydraulic motor is either located in a housing side extension of the structural member supporting the vertical roll to drive it from the outside by spur wheel gearing or by a frictional drive or the hydraulic motor is mounted in the nonrotating supporting axle of the vertical roll and engages on an inner cogged drive ring on the vertical roll from the inside by spur gearing positioned on a transverse plane.

10 Claims, 5 Drawing Sheets

DRIVE APPARATUS FOR THE VERTICAL ROLLS OF A UNIVERSAL ROLLING MILL STAND

FIELD OF THE INVENTION

Our present invention relates to a drive apparatus for the vertical rolls of a universal rolling mill stand.

BACKGROUND OF THE INVENTION

The vertical rolls of a universal rolling mill, in which the vertical rolls are rotatably mounted in a journal block, can be driven to avoid problems when these rolls are engaged by the oncoming billet, bloom ore previously rolled body.

In practice the vertical rolls of a universal rolling mill are often not driven although when a drive has been provided, it usually was of the drag type where the vertical rolls are frictionally entrained by circumferential surfaces of a horizontal roll as described in German Patent 11 18 724.

With this drive the vertical rolls are already placed in rotation before the first pass of the rolled product to avoid impacts on the first pass which can lead to damage.

The geometry of the roll gap requires that the vertical rolls engage the sides or flanges of an I-section in the roll gap before the horizontal rolls engage the cross member or web of the I-section.

The known drive for the vertical rolls requires either outer support of the vertical rolls, i.e. an abandonment of a two-side axle support as described in German Patent 93 321, or an adjusting device for the vertical rolls which must be supplemented by a device to temporarily press the vertical rolls on the end surfaces of the horizontal rolls between passes axially parallel to the horizontal rolls (German Patent 11 18 724).

OBJECTS OF THE INVENTION

It is an object of our invention to provide an improved drive apparatus for the vertical rolls of a rolling mill which will avoid drawbacks of earlier systems.

It is also an object of our invention to provide an improved drive apparatus for the vertical rolls of a rolling mill which avoids the disadvantages of the known friction or drag drives for the vertical rolls and provides a positive drive action for the vertical rolls.

It is an additional object of our invention to provide an improved drive apparatus for the vertical rolls of a rolling mill in which damaging impacts on the first pass of the rolled product through the rolling mill are avoided.

SUMMARY OF THE INVENTION

These objects and others which will become more readily apparent hereinafter are attained in accordance with our invention in a drive apparatus for driving a vertical roll of a universal rolling mill in at least one rotational direction and in which the vertical roll is mounted rotatably on a supporting axle in a bearing block.

According to our invention the drive apparatus comprises an electric motor whose stator is formed by a circular collar of the supporting axle mounted nonrotatably in the bearing block and the vertical roll rotatably mounted on the supporting axle is the rotor of the electric motor.

According to another embodiment of our invention the drive apparatus comprises a hydraulic motor which is positioned in a housing-like extension of the supporting member of the vertical roll and is provided with a driven spur gear by which the vertical roll is directly driven by at least one intermediate spur gear or indirectly by a friction gear.

When the vertical roll is indirectly driven by an intermediate spur gear, the housing-like extension of the supporting member comprises a box opening into the supporting member which is flanged to the supporting member and the vertical roll is provided on at least one end surface with an externally toothed drive ring which is engaged with the intermediate spur gear.

The intermediate spur gear engaged with a driven spur gear is connected nonrotatably with a shaft mounted on both ends in the supporting member which penetrates a filler piece which is mounted in a radial bearing block cavity of the bearing block corresponding to the diameter of the intermediate spur gear and is fixed radially by the inserted shaft.

When the vertical roll is driven by the friction gear in the housing-like extension of the supporting member a slider piece is radially guided which penetrates a radial structural cavity of the supporting member and by which the hydraulic motor is supported in addition to the driven spur gear, the intermediate spur gear and the friction gear and the bearing block with the friction gear is pressed permanently against the vertical roll on an outer supporting wall of the housing-like extension.

In another embodiment of our invention different from the above described examples the drive apparatus comprises a hydraulic motor mounted in a nonrotatable supporting axle of the vertical roll whose driven spur gear drives a rotatably mounted intermediate spur gear which is engaged with the vertical roll provided with an interior cogged drive ring. All gearing is located in a transverse plane running between two roller bearings.

The supporting axle can be advantageously mounted in a nonrotatable supporting sleeve for receiving the inner running ring of both roller bearings which is held against a radial collar of the supporting sleeve which is cut out radially for receiving and mounting a second intermediate spur gear.

The drive moment or torque of the hydraulic or electric drive motor is designed in all cases so that the vertical rolls participate in the deforming process.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
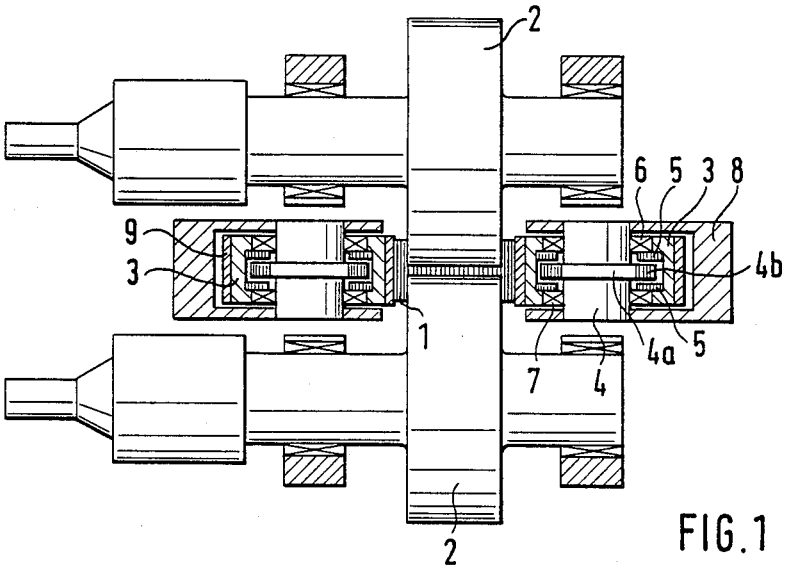
FIG. 1 is a partial vertical cross sectional view through the horizontal and vertical rolls and/or their bearings mounted in a vertical plane with an electric motor for driving the vertical rolls according to our invention.

A universal rolling mill shown schematically in FIG. 1 for rolling an I-section 1 comprises, as is known, two horizontal rolls 2 and two vertical rolls 3 which are each pivotally mounted on a fixed supporting axle 4 inside a bearing block 8 by roller bearings 6 and 7.

For positive driving of each vertical roll 3 an electric motor is built into each bearing block 8 and has a stator formed by a circular collar 4*a* of the supporting axle 4.

The circular collar 4*a* is provided with the primary armature 4*b*. The not-illustrated current feed is effected through the fixed supporting axle 4. The vertical roll 3 is the rotor of the electric motor on which the secondary winding 5 is carried.

Since the vertical rolls 3 are rotors of an electric motor appropriately they are made of satisfactorily magnetizable steel and are each clad with a roll ring 9 made of a wear-resistant material.

Figure 2:
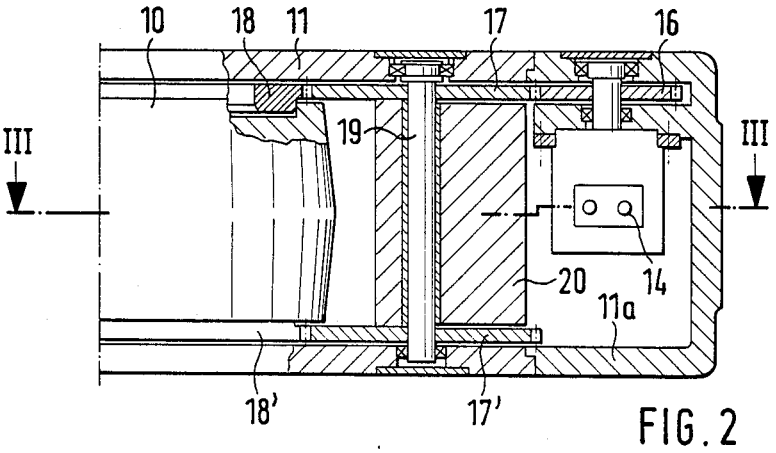
FIG. 2 is a partial axial cross sectional view through the bearing block of a vertical roll with a spur gear drive with a hydraulic motor.
Figure 3:
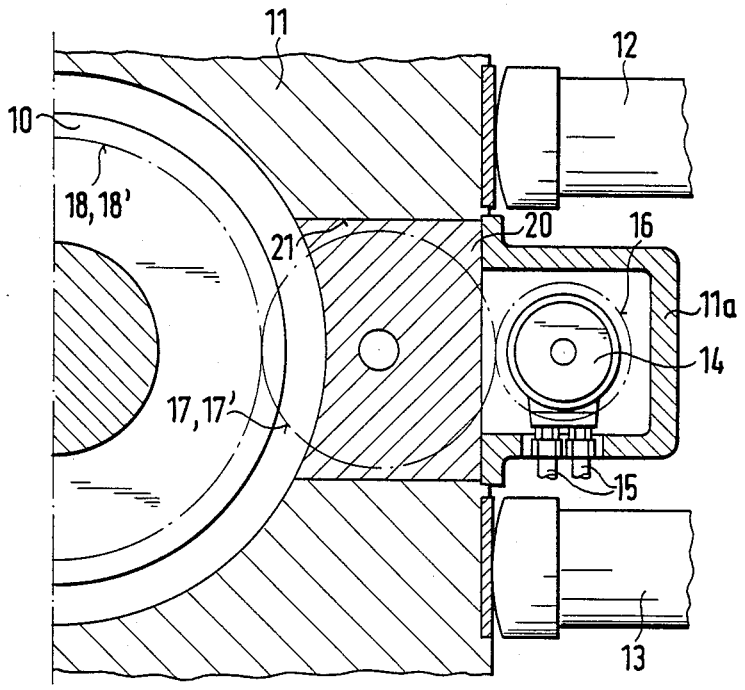
FIG. 3 is a partial horizontal cross sectional view taken along the section line III—III of FIG. 2.

In the embodiment shown in FIGS. 2 and 3 a vertical roll 10 is pivotally mounted inside a bearing block 11 which can be engaged by two push rods 12, 13 of the only partially shown vertical adjusting mechanism against the rolled product. A box 11*a* opening inwardly to the bearing block 11 is flanged between the push rods 12, 13 and is a housing-like extension of the supporting member 11 which receives a hydraulic motor or hydromotor 14 whose pressure lines are conducted from the housing-like extension 11*a*.

The hydraulic motor or hydrometer 14 is provided with a driven spur gear 16. The driven spur gear 16 drives the vertical roll 10 directly by an intermediate spur gear 17 mounted in the bearing block 11. Moreover the vertical roll 10 is provided on an end surface with an externally toothed drive ring 18 which meshes with the intermediate spur gear 17. The intermediate spur gear 17 is connected nonrotatably with a shaft 19 mounted at both ends in bearing block 11 which carries an additional intermediate spur gear 17′ which is engaged with an additional drive ring 18′ of the vertical roll 8.

To be able to build in and axially mount the intermediate spur gear 17 and spur gear 17′ the shaft 19 penetrates a filler piece 20 which is mounted in a radial bearing block cavity 21 appropriate for the diameter of the intermediate spur gear 17, 17′ and is radially fixed by the shaft 19 on which they are mounted.

Figure 4:
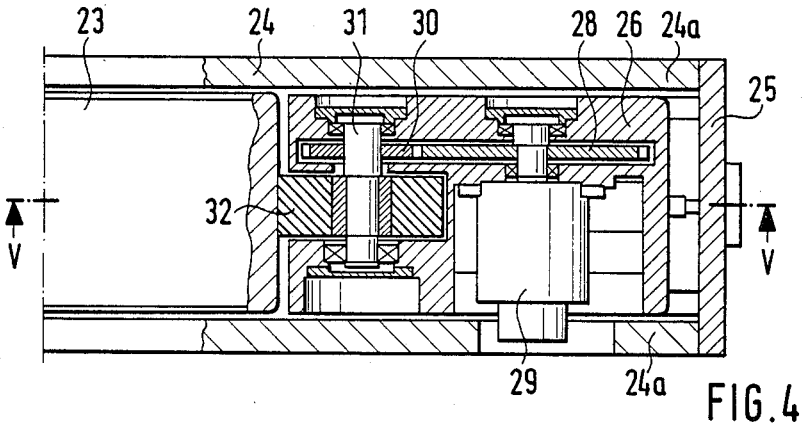
FIG. 4 is a partial vertical cross sectional view through a bearing block of a vertical roll with a friction drive with a hydraulic motor.
Figure 5:
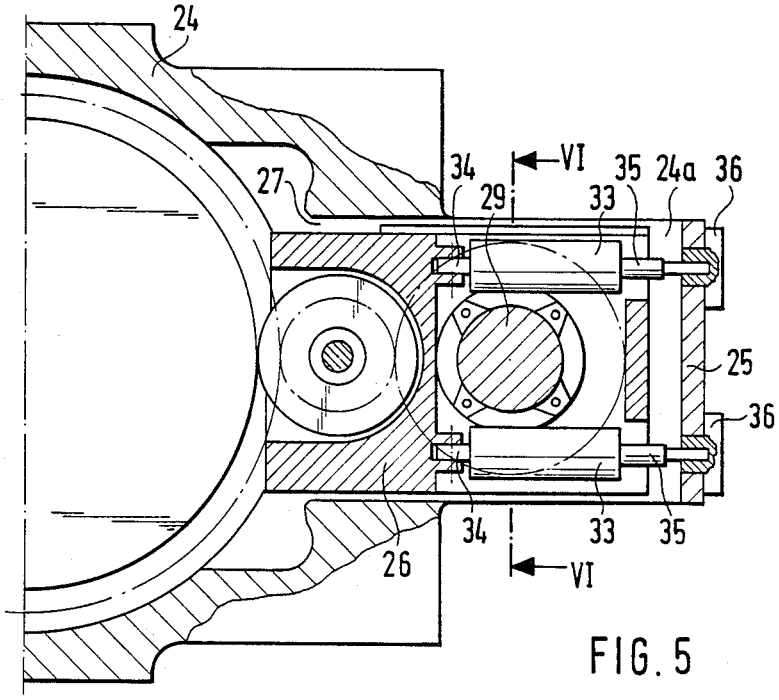
FIG. 5 is a partial horizontal cross sectional view taken along the section line V—V of FIG. 4.
Figure 6:
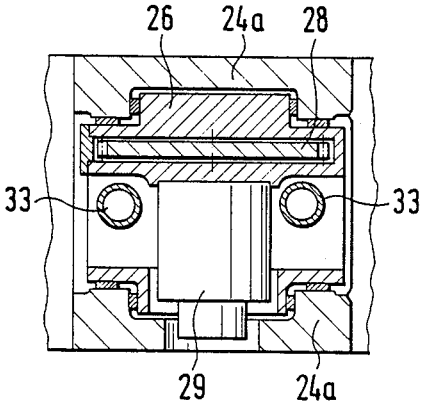
FIG. 6 is a vertical cross sectional view taken along the section line VI—VI in FIG. 5.

In the embodiment of FIGS. 4 to 6 the vertical roll 23 is mounted in a bearing block 24 which is provided with two arm like extensions 24*a* which form a housing together with an outer supporting wall 25 extending laterally exteriorly from the supporting member 24 as shown in FIG. 6.

Between these extensions 24*a* a sliding piece 26 is guided which penetrates and radially fits a radial structural cavity 27 of the bearing block 24.

The slider piece 26 carries a hydraulic motor 29 provided with a driven spur gear 28. The driven spur gear 28 is in engagement with an intermediate spur gear 30 which is rotatably mounted by a shaft 31 in the slider piece 26.

The shaft 31 is connected nonrotatably with a friction gear 32 which drives the vertical roll 23 contacting on its outer circumference.

To adjust the contact pressure of the friction gear 32 the friction gear is pressable permanently against the vertical roll 23 bracing the supporting wall 25 of the housing-like extensions 24*a* against it by two cylinders 33 positioned laterally with respect to the hydraulic motor 29. These cylinders 33 are attached by links 34 with the slider piece 26 and their piston rods 35 are attached by flanged covers 36 with the supporting wall 25.

Figure 7:
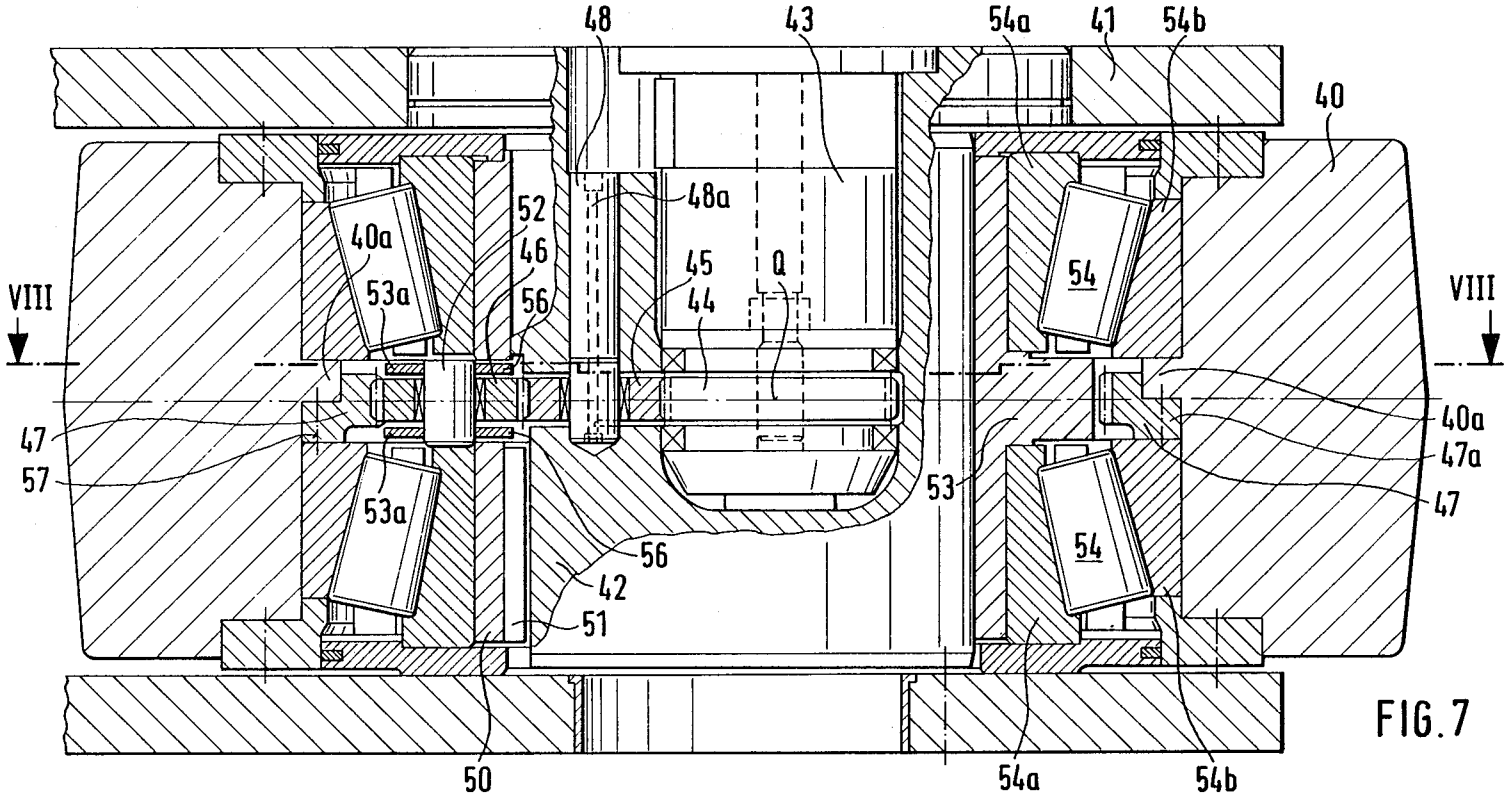
FIG. 7 is a partial vertical axial cross sectional view through a vertical roll with a hydraulic motor mounted inside its supporting axle.
Figure 8:
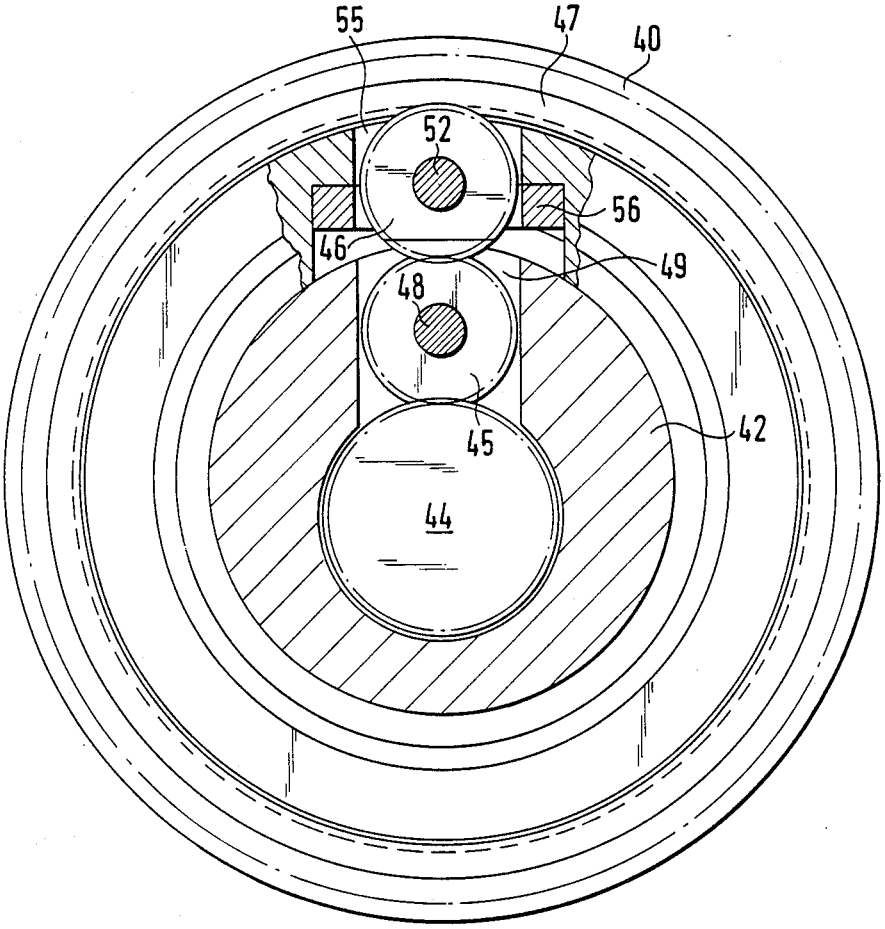
FIG. 8 is a partial axial cross sectional view taken along the section line VIII—VIII in FIG. 7.

The hydraulic inner drive of the vertical roll 40 according to FIGS. 7 and 8 needs no housing-like extension of the bearing block 41 since the hydraulic motor 43 is mounted in the nonrotatable supporting axle 42 of the vertical roll 40.

As FIG. 8 shows, the drive comprises a driven spur gear 44 coaxial with the hydraulic motor 43 coupled to intermediate spur gears 45 and 46 which in turn are coupled to an internally toothed drive ring 47 of the vertical roll 40. The hydraulic motor 43 is mounted eccentrically on the supporting axle 42 to provide space for an opposing eccentrically mounted shaft 48 mounted in the supporting axle 42 for support of the intermediate spur gear 45. The supporting axle 42 is provided with a radial bearing block cavity 49 for accomodating this spur gear 45.

Since the shaft 52 for the second intermediate spur gear 46 must be held outside of the supporting axle 42 the supporting axle 42 is surrounded by a supporting sleeve 50 which is connected by an adjusting spring member 51 rigidly with the nonrotatable supporting axle 42. This supporting sleeve 50 has a symmetrical collar 53 located in transverse plane Q (FIG. 7, right half) against which the inner rings 54*a* of two inclined roller bearings 54 are clamped. The purpose of this collar 53 is to hold the shaft 52. The supporting jacket 50 and the collar 53 are provided with a radial opening 55 in such a way that the shaft 52 can be held on the outside on the sides 53*a* of the collar 53 and on the inside by the supporting cover 56 (FIG. 8).

The internally toothed drive ring 47 of the vertical roll 40 is not molded on the roll body because of the method of manufacture but a stepped ring is mounted by threading 57 on an interiorly projecting collar 40*a* of the vertical roll 40. The collar 40*a* and the step 47*a* projecting exteriorly to the interiorly cogged drive ring 47 in the circular plane of the peripherally divided threading 57 form a joint abutting surface for clamping the outer ring 54*b* of both inclined roller bearings 54.

All embodiments of our invention with a hydraulic drive according to FIGS. 2 to 8 allow the spur gears to be mounted in a closed chamber which can be sealed from the exterior. Lubricating oil can be provided for lubrication of the roller bearings 54 for example by an interior duct 48*a* of the shaft 48 as seen in FIGS. 7 and 8. The holding of the outer running ring 54*b* of the bearings 54 against the collar 40*a* and/or the step 47*a* has a sealing function also.

We claim:

1. In a drive apparatus for driving a vertical roll of a universal rolling mill in at least one rotational direction in which said vertical roll is rotatably mounted on a supporting axle in a supporting member, the improvement wherein said drive apparatus comprises a hydraulic motor mounted in said supporting axle of said vertical roll whose driven spur gear drives a pivotally mounted intermediate spur gear which is engaged with said vertical roll provided with an interior cogged drive ring.

2. A drive apparatus for driving a vertical roll of a universal rolling mill rotatably mounted on a supporting axle in a supporting member comprising:

a hydraulic motor mounted in said supporting axle of said vertical roll;

a driven spur gear of said hydraulic motor;

a pivotally mounted intermediate spur gear engaged with and driven by said driven spur gear and which at least indirectly acts on an interior cogged drive ring of said vertical roll, all gearing including said driven spur gear;

two roller bearings each with an inner running ring, the gearing including said driven spur gear; and a nonrotatable supporting sleeve receiving said inner running rings of both of said roller bearings which are held against a radial collar of said supporting sleeve which is cut out radially for receiving and mounting a second one of said intermediate spur gears.

3. A universal mill, comprising:

a pair of horizontal rolls rotatably mounted in bearing blocks at least at one end of said pair;

a hollow vertical roll of magnetizable steel at said end;

a support member disposed between said blocks and holding said vertical roll for rotation about a vertical axis;

a nonrotatable support shaft mounted in said support member and carrying said vertical roll for rotation thereof about said vertical axis, said support shaft being formed with a circular collar;

an electric drive for said roll comprising:

a stator winding formed on said circular collar and supplied with electric current through said nonrotatable support shaft, and annular secondary windings in said vertical roll and secured thereto, said secondary windings straddling said primary winding and said primary winding being received between said secondary windings, whereby said primary winding and said secondary windings coact to form an electric motor driving said vertical roll about said vertical axis; and a roll ring of a wear-resistant material on said vertical roll.

4. In a universal mill having a pair of horizontal rolls, and at least one vertical roll, the improvement which comprises a drive for rotating said vertical roll about a vertical axis, said drive comprising:

a support member in which said vertical roll is journaled for rotation about said vertical axis;

a hydraulic motor mounted on said support member and having a vertical axis;

a drive gear operatively connected to said motor and rotatable about the vertical axis of said hydraulic motor;

an intermediate gear journaled on and in said support member and rotatable about a vertical axis between the vertical axes of said vertical roll and said hydraulic motor, said intermediate gear being in mesh with said drive gear; and an element rotatable about said vertical axis of said intermediate gear and operatively connected to said vertical roll for rotating same.

5. The improvement defined in claim 4 wherein:

said element is one of a pair of driven gears rotatable about the axis of said vertical roll, connected with said vertical roll and meshing with said intermediate gear, said intermediate gear having axially spaced gear wheels meshing with said driven gears;

said support member has a filling body traversed by a shaft carrying said gear wheels and connecting them for joint rotation; and said hydraulic motor is received in a housing flanged laterally on said support member.

6. The improvement defined in claim 4 wherein:

said hydraulic motor is mounted in a body slidably radially of said vertical roll in said support member;

said intermediate gear is mounted on a shaft journaled in said body;

said element is a friction wheel mounted on said shaft and rotatable thereby, said friction wheel bearing against said vertical roll; and said drive further comprises means for shifting said body and said friction wheel toward said vertical roll in said support member.

7. The improvement defined in claim 4 wherein:

said hydraulic motor is received in a body on which said vertical roll is journaled and is surrounded by said vertical roll;

said vertical roll has an internal ring gear meshing with a spur gear rotatable about a vertical axis inwardly of said ring gear; and said intermediate gear meshes with said spur gear.

8. In a drive apparatus for driving a vertical roll of a universal rolling mill in at least one rotational direction in which said vertical roll is rotatably mounted on a supporting axle in a supporting member, the improvement wherein said drive apparatus comprises a hydraulic motor mounted in said supporting axle of said vertical roll whose driven spur gear drives a pivotally mounted intermediate spur gear which is engaged with said vertical roll provided with an interior cogged drive ring, all gearing being located in a transverse plane running between two roller bearings.

9. The improvement according to claim 8 wherein said supporting axle being mounted in a nonrotatable supporting sleeve for receiving the inner running ring of both of said roller bearings which are held against a radial collar of said supporting sleeve which is cut out radially for receiving and mounting a second one of said intermediate spur gears.

10. A drive apparatus for driving a vertical roll of a universal rolling mill rotatably mounted on a supporting axle in a supporting member comprising:

a hydraulic motor mounted in said supporting axle of said vertical roll;

a driven spur gear of said hydraulic motor;

a pivotally mounted intermediate spur gear engaged with and driven by said spur gear and which at least indirectly acts on an interior cogged drive ring of said vertical roll, all gearing including said driven spur gear;

two roller bearings each with an inner running ring, the gearing including said driven spur gear, said intermediate spur gear and said interior cogged drive ring being located in a transverse plane running between said two roller bearings; and a nonrotatable supporting sleeve receiving said inner running rings of both of said roller bearings which are held against a radial collar of said supporting sleeve which is cut out radially for receiving and mounting a second one of said intermediate spur gears.

* * * * *

UNITED STATES PATENT AND TRADEMARK OFFICE

CERTIFICATE OF CORRECTION

PATENT NO. : 4,864,838

DATED : 12 September 1989

INVENTOR(S) : George ENGEL et al

It is certified that error appears in the above-identified patent and that said Letters Patent is hereby corrected as shown below:

On the title page;

Item [75] Sixth and Seventh Inventors' names and addresses to be added and to read:

-- Siegfried Küsel, Dusseldorf,
Dieter Nobis, Neuss, -- (both of Federal Republic of Germany).

Signed and Sealed this

Sixteenth Day of October, 1990

*Attest:*

*Attesting Officer*

HARRY F. MANBECK, JR.

*Commissioner of Patents and Trademarks*